US006962461B2

(12) United States Patent
Choi et al.

(10) Patent No.: US 6,962,461 B2
(45) Date of Patent: Nov. 8, 2005

(54) MULTI-PURPOSE ANTI-GLARE DIVIDER USING MODULAR APPROACH

(76) Inventors: Baek Sung Choi, 24170 Avenida Rancheros, #D, Diamond Bar, CA (US) 91765; Eunice Chulsook Choi, 24170 Avenida Rancheros, #D, Diamond Bar, CA (US) 91765

( * ) Notice: Subject to any disclaimer, the term of this patent is extended or adjusted under 35 U.S.C. 154(b) by 0 days.

(21) Appl. No.: 10/842,787

(22) Filed: May 11, 2004

(65) Prior Publication Data

US 2005/0031410 A1 Feb. 10, 2005

Related U.S. Application Data

(63) Continuation-in-part of application No. 10/633,479, filed on Aug. 4, 2003, now abandoned.

(51) Int. Cl.[7] ..... E01F 13/00
(52) U.S. Cl. ..... 404/6; 256/13.1
(58) Field of Search ..... 404/6, 9, 10, 11, 404/12; 256/1, 13.1; 49/49

(56) References Cited

U.S. PATENT DOCUMENTS

| | | | | |
|---|---|---|---|---|
| 4,249,832 A | | 2/1981 | Schmanski | |
| 4,338,041 A | | 7/1982 | Schmanski | |
| 4,751,893 A | | 6/1988 | Brantley | |
| 4,958,954 A | | 9/1990 | Schmanski | |
| 5,015,119 A | | 5/1991 | Schmanski | |
| 5,022,781 A | | 6/1991 | Smith | |
| 5,181,695 A | | 1/1993 | Arthur | |
| 5,190,394 A | | 3/1993 | Mallon | |
| 5,641,241 A | | 6/1997 | Rushing | |
| 6,059,487 A | * | 5/2000 | Haga et al. | 404/6 |
| 6,149,338 A | | 11/2000 | Anderson | |

FOREIGN PATENT DOCUMENTS

| | | | | |
|---|---|---|---|---|
| EP | 1401026 A | * | 3/2004 | H01L 31/045 |
| GB | 2246173 A | * | 1/1992 | F03D 9/00 |
| GB | 2278645 A | * | 12/1994 | F03D 9/00 |
| JP | 09053210 A | * | 2/1997 | E01F 8/00 |
| WO | WO 200131196 A | * | 5/2001 | F03D 11/04 |

* cited by examiner

*Primary Examiner*—Robert E. Pezzuto
*Assistant Examiner*—Alexandra Pechhold
(74) *Attorney, Agent, or Firm*—Lawrence N. Ginsberg

(57) ABSTRACT

A multi-purpose anti-glare divider system for minimizing glare from oncoming traffic on a two-way road. The anti-glare divider system includes at least one light blocking module arranged and constructed to minimize glare from oncoming traffic. An electrical generating system is associated with the light blocking module for generating electrical energy for use by an auxiliary device. A mounting system supports the light blocking module in a desired position relative to the road.

20 Claims, 6 Drawing Sheets

FIG. 6
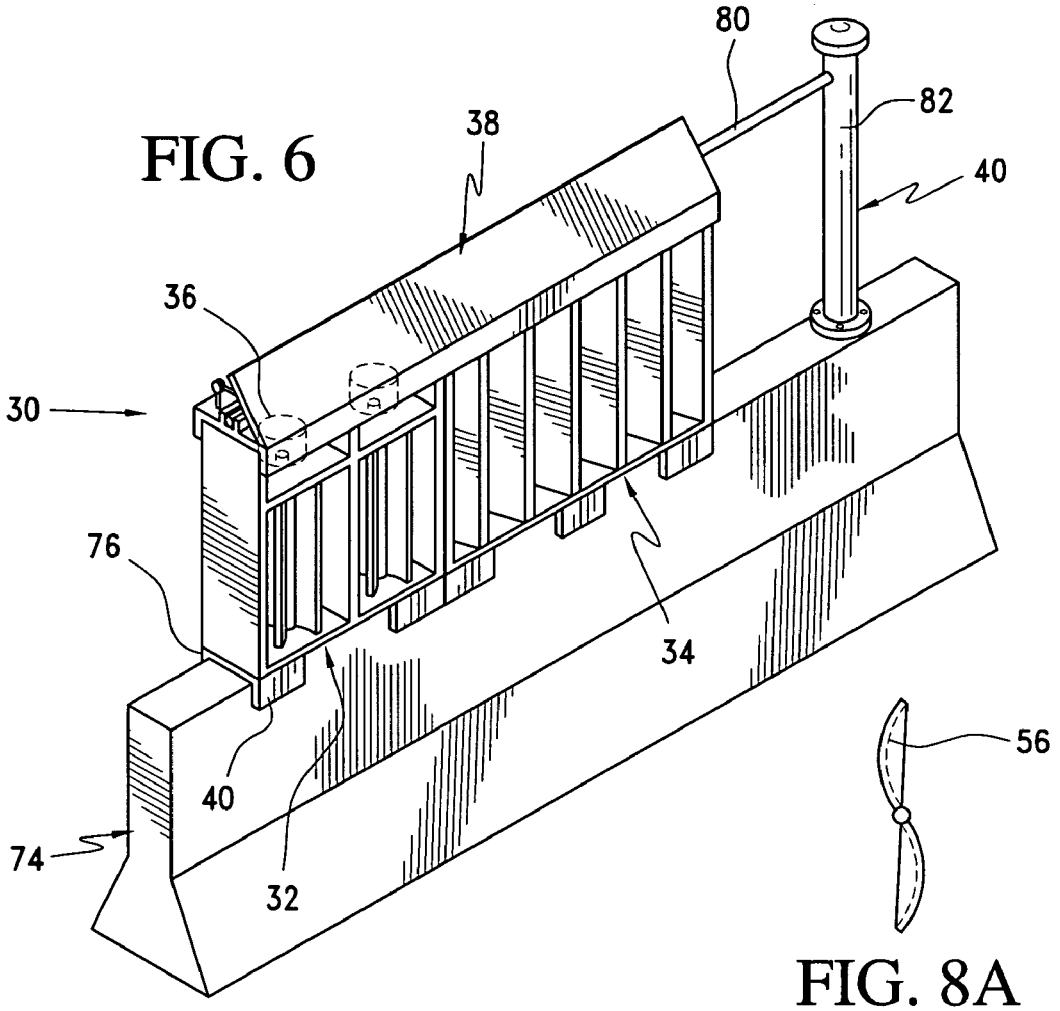
FIG. 8A
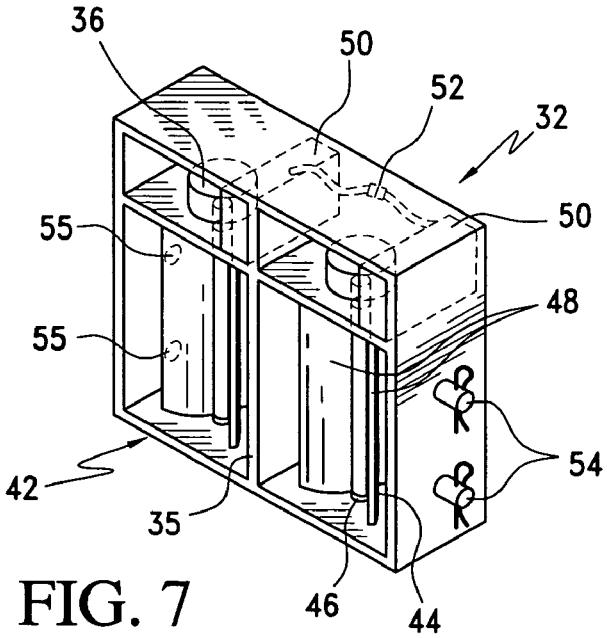
FIG. 7
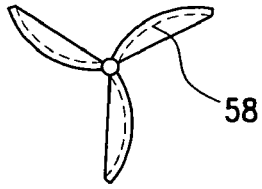
FIG. 8B
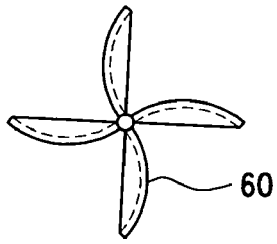
FIG. 8C

FIG. 12
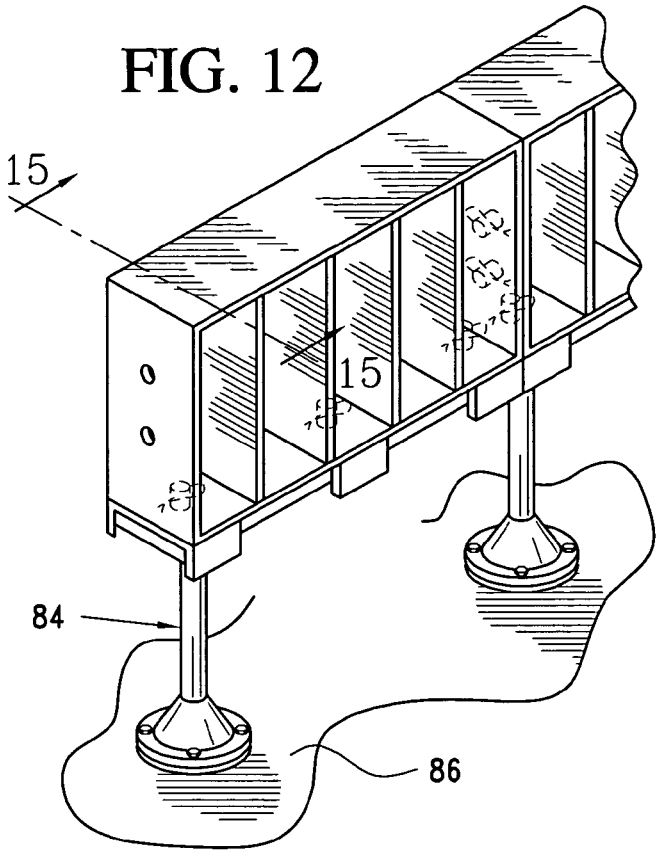
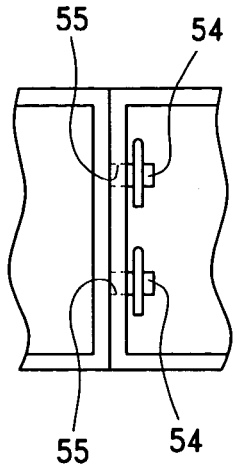
FIG. 13
FIG. 14
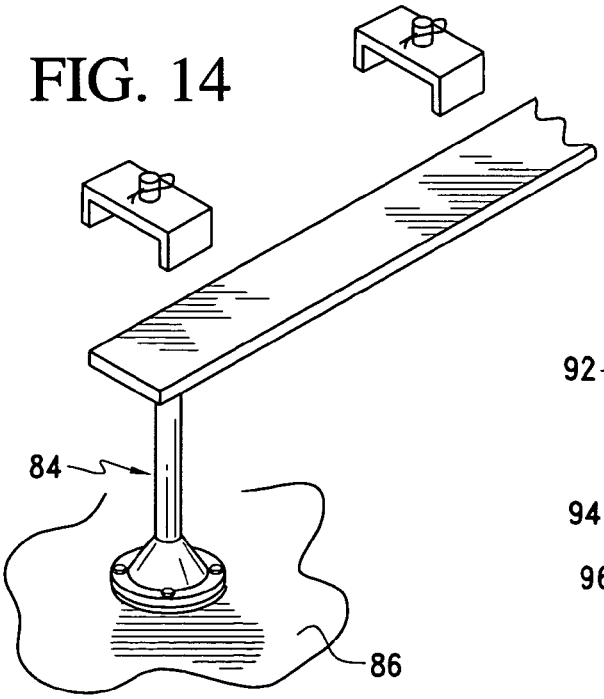
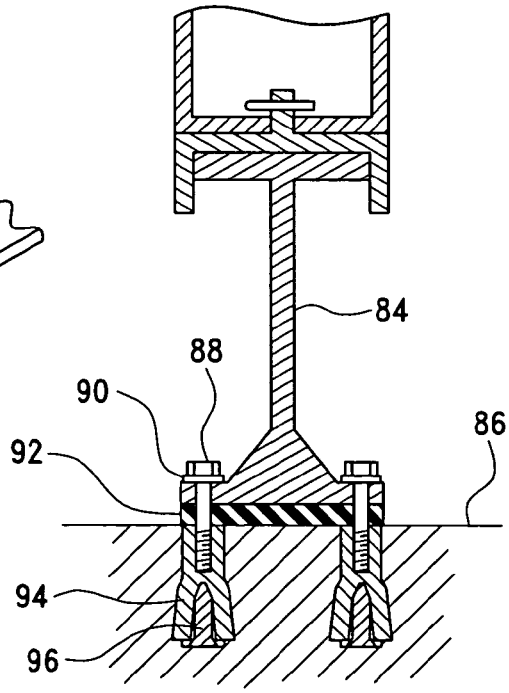
FIG. 15

MULTI-PURPOSE ANTI-GLARE DIVIDER USING MODULAR APPROACH

CROSS REFERENCE TO RELATED APPLICATION

This is a continuation-in-part of U.S. Ser. No. 10/633,479, entitled "Anti-glare Safety Divider Using Modular Approach", filed Aug. 4, 2003 now abandoned.

BACKGROUND OF THE INVENTION

1. Field of the Invention

This invention is related to anti-glare light dividers for highways and local roads.

2. Description of the Related Art

When driving a car on a highway at nighttime, drivers become temporarily blinded from the glaring light of oncoming vehicles on the opposite side of the concrete road barrier. Many types of anti-glare panels are installed onto road dividers in order to shield the light from ongoing traffic. The purpose of this invention is to provide anti-glare light shields, which minimize the glare of oncoming traffic without blocking the view of the opposite road. It is efficient in that the anti-glare safety dividers utilize the existing low concrete barriers. A convenience of this invention is that it provides anti-glare dividers for various roadways without concrete barriers as well as for highways with concrete barriers U.S. Pat. No. 4,338,041 to Schmanski, U.S. Pat. No. 5,181,695 to Arthur, and U.S. Pat. No. 5,641,241 to Rushing illustrate an anti-glare plate system by mounting plates or paddles onto the road barrier with fixed and/or adjustable distances between the plates. Those plates are mounted vertically and lie across the road barrier. When two cars from opposite lanes approach one another from a distance, the lights from the opposite car appear to flash on and off because of the gaps between the panels. U.S. Pat. No. 5,015,119 to Schmanski and U.S. Pat. No. 5,022,781 to Smith illustrate another type of anti-glare module. In their invention, the plate or modules are mounted vertically along the road barrier. U.S. Pat. No. 4,751,893 to Brantely illustrates a different type of corrugated module mounting on the road barrier. U.S. Pat. No. 4,249,832 to Schmanski illustrates a vertically rotating web structure to protect a delineator installed on the median barrier during impact.

SUMMARY OF THE INVENTION

In order to overcome the aforementioned problems, an anti-glare safety divider using blade frames that can house vertical blades in varying degrees and angles has been invented. This module that consists of a blade frame and built-in vertical blades may be mounted between two horizontal bars/pipes, which connect the poles/pipes by erecting these into the concrete barriers or into the ground itself.

This invention blocks headlight glare almost completely from oncoming vehicles that are moving between 0 to 45 degrees. Viewing from the innermost lane (leftmost in the United States) is problematic in a multi-lane roadway.

Glare coming from a 45-degree angle or higher will be blocked effectively, although not completely, with incrementally angled vertical blades. Blades with incremental angles increase efficiency for the drivers on the other lanes of the multi-lane roadway.

The current invention is correlated to an anti-glare safety light shield, mountable on a road divider, comprised of a blade frame and a series of vertical blades rigidly installed in the frame. The vertical blades incrementally change angles from 60 degrees to 90 degrees depending on the direction of traffic and/or rotating blades having two or more wings per blade.

Another type of glare blocking device has been invented. This particular type uses a rotor with wings in order to make it movable. It is designed to rotate with the impact of wind or whirlwind caused by passing vehicles as it serves as a glare-blocking device.

The primary object of this invention is to block headlight glare effectively with a wide range of angles from oncoming vehicles. This invention can also provide an effective solution to headlight glare on various roadways because the anti-glare safety divider may be used either on top of the concrete divider or on the ground where concrete barriers are not suitable to use. The object is to alleviate pressure from the side wind or whirlwind by providing space between blades through which air can flow freely. The space between the blades also allows people to see the other side of the street when installed in the city.

An added objective is to provide a method that requires low maintenance. A modular approach allows maintenance crew to replace a damaged section relatively easily. Another aim is to provide a deterrent to jaywalking.

An additional purpose is to reduce the risk of traffic accidents in a bend of the road or in a no passing zone on a two-lane, two-way roadway.

In another broad aspect the present invention comprises a multi-purpose anti-glare divider system for minimizing glare from oncoming traffic on a two-way road. The anti-glare divider system includes at least one light blocking module arranged and constructed to minimize glare from oncoming traffic. An electrical generating system is associated with the light blocking module for generating electrical energy for use by an auxiliary device. A mounting system supports the light blocking module in a desired position relative to the road. The term "two-way" road is defined broadly to include both local and multi-lane highways.

One of the advantages of using the present invention is that, in a remote area like mountain or desert where commercial power is not easily available, this system can be useful by providing, not only an accident reducing divider but also electricity generation utilizing easily available resources such as solar energy and wind.

BRIEF DESCRIPTION OF THE DRAWINGS

FIG. 6 is a perspective view of a multi-purpose anti-glare divider system of the present invention.

FIG. 7 is a perspective view of a rotatable-type light blocking module of the multi-purpose anti-glare divider system of FIG. 6.

FIG. 8A is a top view of a two wing rotor embodiment of the rotatable-type light blocking module of FIG. 7.

FIG. 8B is a top view of a three wing rotor embodiment of the rotatable-type light blocking module of FIG. 7.

FIG. 8C is a top view of a four wing rotor embodiment of the rotatable-type light blocking module of FIG. 7.

FIG. 12 is a perspective view of a multi-purpose anti-glare divider system that is secured to the road via pedestal assemblies.

FIG. 13 is a partial front elevational view showing the connection of two fixed-type light blocking modules.

FIG. 14 is an exploded perspective view showing the positioning of the mounting devices of the FIG. 12 embodiment.

FIG. 15 is a cross-sectional view of the FIG. 12 device, taken along line 15—15 of FIG. 12.

DETAILED DESCRIPTION OF THE INVENTION

Figure 1:
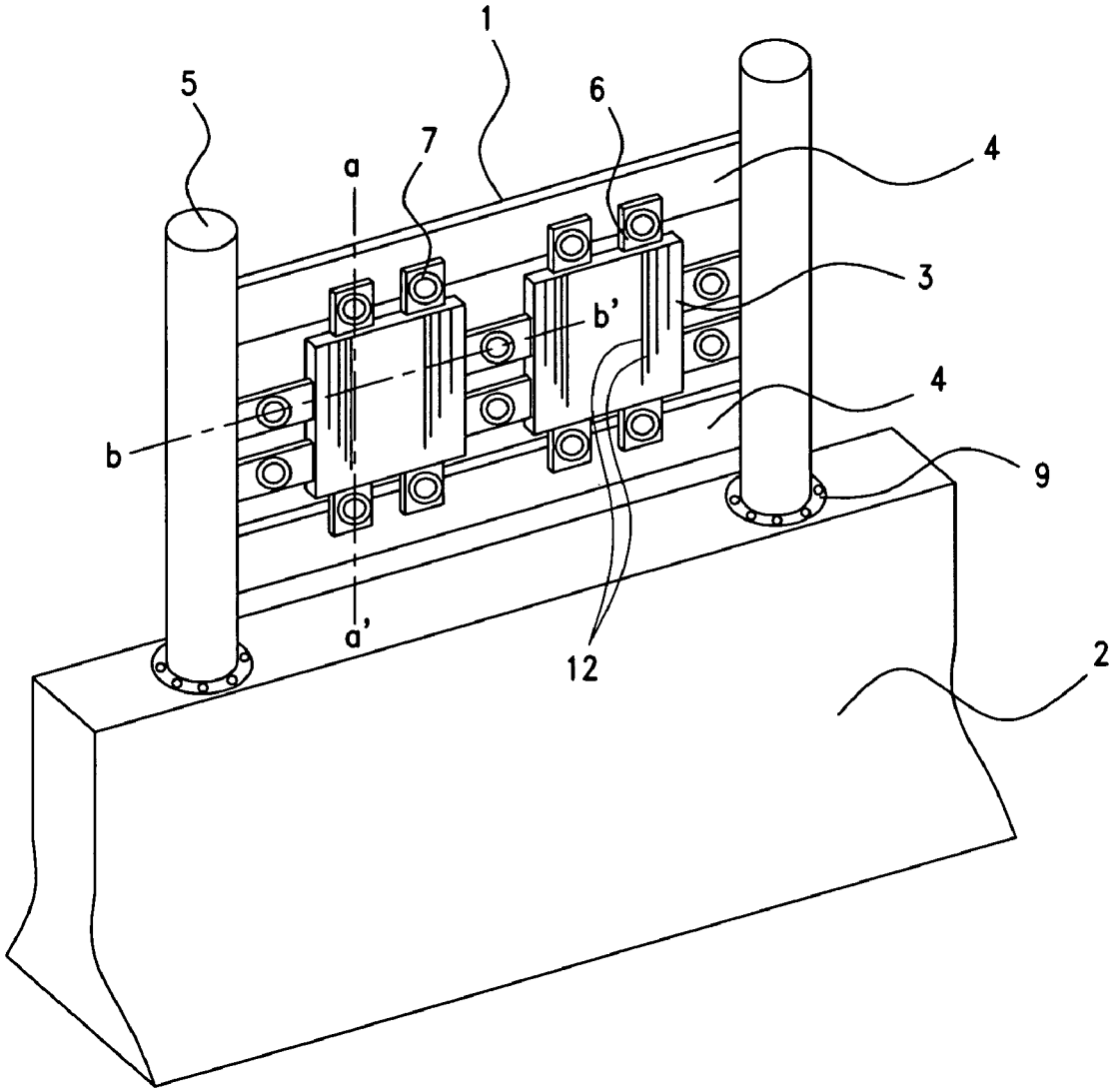
FIG. 1 is the perspective view of a glare proof safety divider frame mounted on a road barrier. It is equipped with blades having different angles dependant on the plane of the road.

FIG. 1 is the perspective view of a first embodiment of an anti-glare safety divider frame (1) mounted on a road barrier (2), which is equipped with a blade frame (3) having a series of vertical blades (12) that are rigidly installed into a frame with incrementally changing angles from 60 to 90 degrees depending on the direction of traffic. The anti-glare safety divider mounting frame (1) is comprised of two intersecting bars (4), two vertical poles/pipes (5), blade frame (3), plurality of extends (6) extending from the blade frame (3), and bolts (7) and nuts (8) for attaching the blade frame (3) to the crossing bars (4). The anti-glare safety divider frame (1) is mounted on and anchored (9) onto a road barrier (2).

Figure 2:
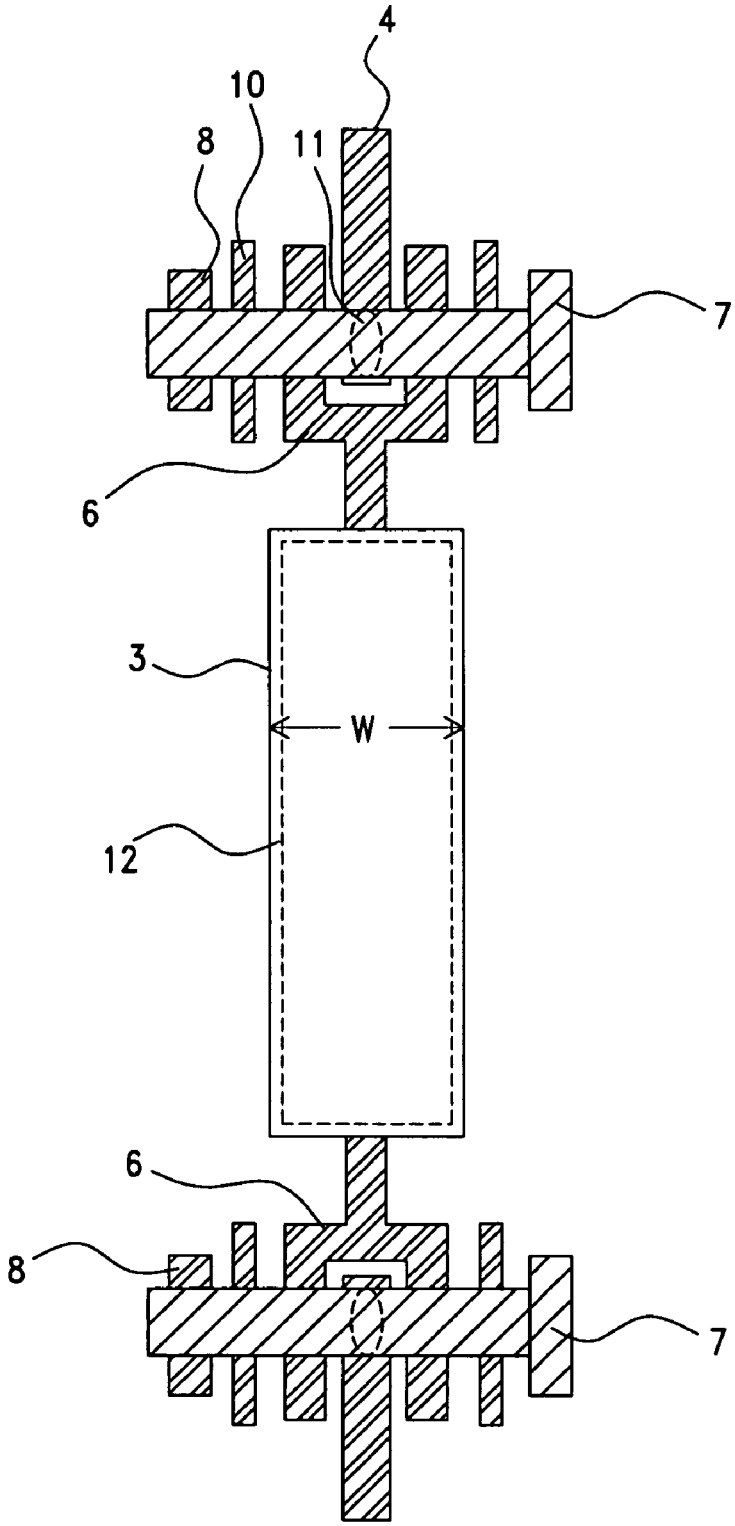
FIG. 2 is a cross sectional view of the anti-glare safety divider mounting frame along the line a–a' in FIG. 1.

FIG. 2 is a cross sectional view of the anti-glare safety divider mounting frame (1) along the a–a' line in FIG. 1. The intersecting bars (4) are thin and rectangular. The blade frame (3) has a plurality of extends (6) that have holes (11) for bolts (7) and nuts (8) in order to fix the blade frame (3) onto the crossing bars (4). Washers (10) are inserted between the crossing bars (4), bolts (7), and nuts (8). The width, w, of the frame (3) may be, for example, from about 2 cm to 30 cm depending on the strength of the material used for the frame. The blades should not stick out beyond the edge of the frame. The frame is generally about the same width as the blades (12). The length of the frame (3) may range from about 60 cm to about 120 cm. The height of the frame (3) may range from about 50 cm to 80 cm when installed onto the concrete barrier. The height of the frame (3) might be extended from about 100 cm to 150 cm when installed in a local street.

Figure 3:
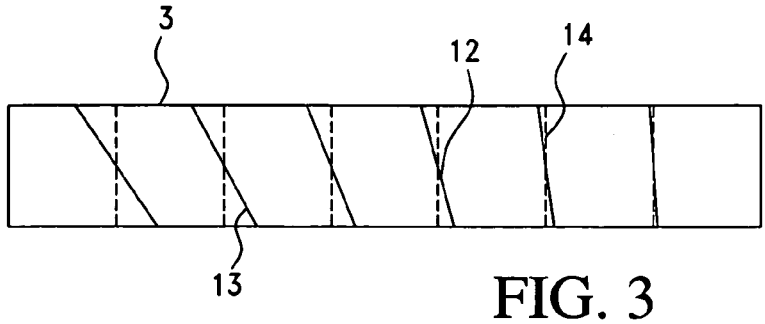
FIG. 3 is an aerial cross sectional view of a blade along the line b–b' in FIG. 1.

FIG. 3 is an aerial cross sectional view of a blade frame (3) along the b–b' line in FIG. 1. The pluralities of blades (12) are installed inside of a blade frame (3). The installed blades (12) can gradually change angles from 90 to 60 degrees depending on (13) the transactional lines (14) of the road. The blades are made of non-transparent and sturdy, yet lightweight material.

Figure 4:
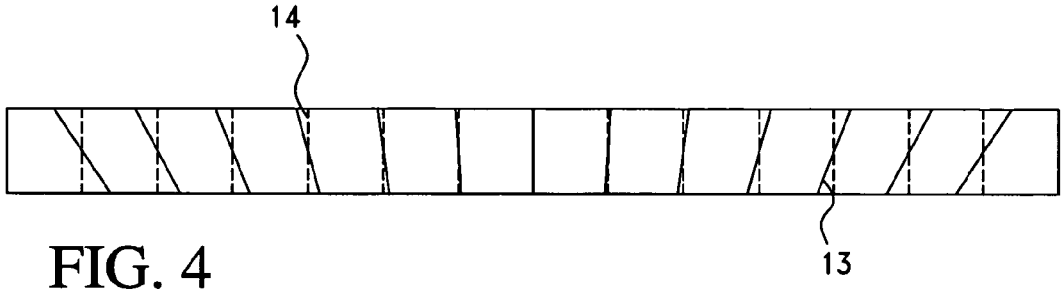
FIG. 4 is an aerial cross sectional view of an alternating arrangement of blade frames from FIG. 3.

FIG. 4 is an aerial cross sectional view of an alternating arrangement of the anti-glare safety blade frame (3) from FIG. 3. Arranging the blade frames (3), like FIG. 4, causes the light from oncoming traffic to be shielded more effectively.

Figure 5:
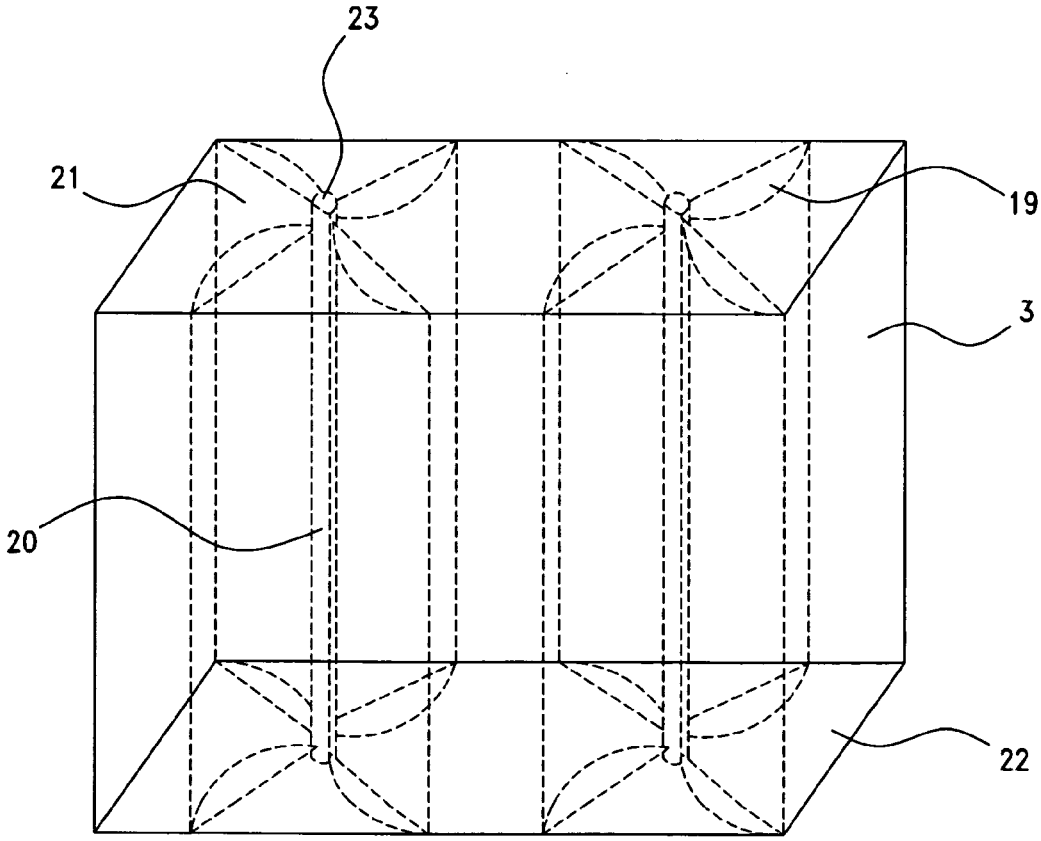
FIG. 5 is a perspective view of a four-web wing anti-glare safety divider blade frame for mounting onto a road barrier.

FIG. 5 is a perspective view of another blade frame (3) that is equipped with four web rotating wing blades. FIG. 5 illustrates only one example of the various blades. The number of wings per blade can be changed from two to four or possibly more. Each four-web wing blade (19) is attached to a rotating shaft (20), which is installed vertically onto a frame (3) between the upper-plates (21) and lower-plates (22) by conventional means (23) such as bearings. These rotating blades will weaken the strength of light from a vehicle across the road barrier while leaving a gap through which to view the highway across the barrier.

The best mode of this invention is to make a module and blades with light and various materials, such as aluminum, polystyrene, solid PVC, polypropylene, high-density polyethylene, and stainless steel. The blades should be installed within the limit of the width of the blade frame.

Referring now to FIG. 6 a preferred embodiment of a multi-purpose anti-glare divider system of the present invention is illustrated, designated generally as 30. The multi-purpose anti-glare divider system 30 includes light blocking modules 32, 34 arranged and constructed to minimize glare from oncoming traffic. An electrical generating system, designated 36 and/or 38, is associated with the light blocking modules 32, 34 for generating electrical energy for use by an auxiliary device. A mounting system, designated generally as 40, supports the light blocking modules 32, 34 in respective desired positions relative to the road.

Examples of auxiliary devices may include, for example, warning signals, traffic signals, warning signs, telecommunication systems, and electronic lane markers.

Referring now to FIG. 7, a rotatable-type light blocking module 32 is illustrated. The module 32 includes a blade mounting frame assembly 42.

The frame assembly 42 is preferably formed of sturdy, yet lightweight material. It is preferably rectangular. It may have a depth of, for example, about 5 cm to 30 cm. The length of a frame assembly 42 may be, for example, 90 cm to 4.5 m. Its height may vary. If installed on the concrete barrier, it may be 60 cm to 90 cm. It may be, for example, 1.2 m to 1.8 m, however, when installed in the local street.

The blade mounting frame assembly 42 supports a rotor assembly 44 that includes a shaft 46 that supports a plurality of wings (i.e. blades) 48. These wings 48 will be described in more detail below. The rotor assembly 44 attaches to the electrical generating system 36, which, is a generator assembly. The rotor assembly 44 can be actuated by side winds or by whirlwinds caused by passing vehicles. Individual rotor assemblies 44 may be separated by suitable dividers 35.

An energy storage system 50 that comprises a regulator and rechargeable battery is connected to the generator assembly. The separate systems 50 may be connected using suitable connectors 52. If required, rechargeable batteries can be placed in other locations such as outside of the divider as needed.

Adjoining light blocking modules 32 may be connected by suitable means such as protruding connector safety pin assemblies 54 that engage holes 55 in the adjoining module.

Referring now to FIGS. 8A–C, upper views of two-wing, three-wing and four-wing embodiments are illustrated, respectively designated generally as 56, 58 and 60. Each wing has a concave expanded c-shape. In FIG. 8A the two wings are at 180° from each other. In FIG. 8B the three wings are at 120° from each other. In FIG. 8C the four wings are at 90° from each other. Although the number of wings may be determined by various factors, a rotor with 3 wings is preferred.

Unless used with a vertical blade or a partition (divider), a rotor with 2 wings may not block glare effectively when it stops at the position where one wing points toward the opposite side of the road, (i.e., oncoming traffic or left side of the roadway) with less than 45 degree angle to the direction of the traffic on the right side of the roadway. On the other hand, a rotor with 3 wings performs the intended function regardless of the angle of the wings even when the rotor stops rotation. Thus, as far as one glare-blocking device is concerned, even drivers in the rightmost lane in a multi-lane roadway may be protected from glare if a rotor with 3 or more wings is used. However, a rotor with more than 4 wings may be too costly.

The rotor is designed to rotate clockwise as viewed from the top (for where a vehicle keeps left as in England or Japan) or counter-clockwise (for where a vehicle keeps right) mostly by the wind caused by passing vehicles.

Figure 9:
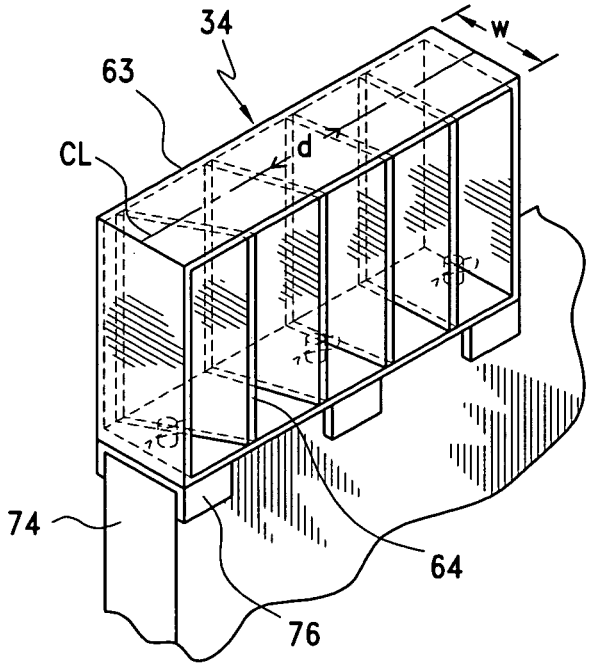
FIG. 9 is a perspective view of a fixed-type light blocking module of the multi-purpose anti-glare divider system of FIG. 6.

Referring now to FIG. 9, a fixed-type light blocking module 34 is illustrated. This module 62 also includes a blade mounting frame assembly 63. In this embodiment, as in the FIG. 1 embodiment, the primary function of the blades 64 is to block the light from oncoming vehicles. The spaced fixed blades 64 are mounted in the blade mounting frame assembly. The mounting frame assembly 63 has a longitudinal center line (CL) substantially parallel to the direction of the road. The spaced fixed blades 64 are positioned to have their angles oriented from about 60° to about 90° from the center line. Blades 64 should be made of non-transparent, sturdy, yet lightweight material. The distance, d, between blades may be approximately the same as the width, w, of the frame assembly 63.

Figure 10:
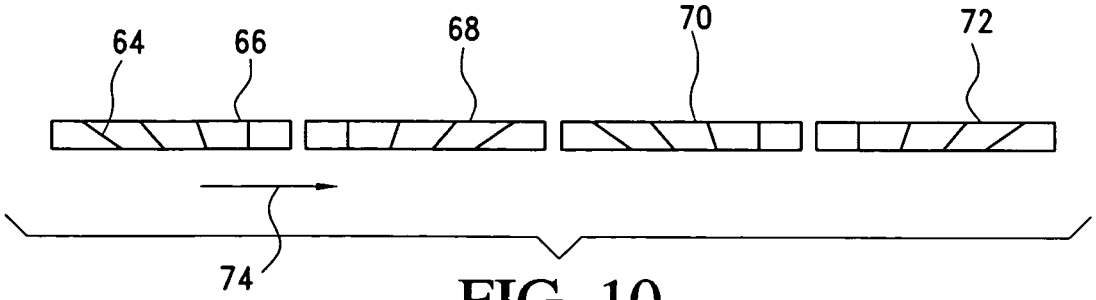
FIG. 10 is a schematic illustration showing a preferred orientation of the fixed blades if only fixed modules are installed.

FIG. 10 is a top schematic view showing preferred orientations of the blades 64 in modules 66, 68, 70, 72. The angle of the first blade (or furthest one viewed from the driver at a given moment while approaching the divider) is substantially perpendicular to the direction (designated by arrow 74) of the traffic. The angle of the last blade (or closest one to the driver in the innermost lane) within the border, i.e. frame assembly, should not exceed 30 degrees in reference to the first blade, which is similar to rotating the first blade 30 degrees counter-clockwise.

All blades in-between would have degrees gradually increasing (or rotating counter-clockwise gradually). For example, if there are seven blades in a border, the first blade would be perpendicular to the direction of the traffic. The angle of the next blade in reference to the first one would be 5 degrees. The angle of the third one would be 10 degrees. Then, the fourth one would be 15, the fifth one 20, the sixth one 25. Finally, the angle of the seventh one would be 30 degrees.

This increasing angle would increase efficiency of the blades blocking light from more than 45 degrees in reference to the direction of a driver in the leftmost (or innermost) lane. Angled blades also block light from a bend to the left more efficiently than the blades that are perpendicular to the direction of the traffic.

If the angle of the last blade exceeds 30 degrees, blades will increase the resistance to the side wind by hindering airflow. These blades with more than 30 degree angle will also block the line of sight in the local street, i.e. ability to see the other side through the module.

By limiting the maximum angle to 30 degrees, blades can perform better because they will not impede airflow too much or completely block the line of sight in the local street.

By increasing the angles of the blades, drivers on the right lanes of the roadway will experience less glare than using only the perpendicular blades. Consequently, in a straight road, a driver in a moving vehicle in the innermost lane would not see glare from less than 45 degree, thus, eliminating most of glare from oncoming traffic.

As can be seen in FIG. 10, if only fixed-type modules are installed, not all modules will be installed in the same manner. After the first module is installed, the second one will be rotated horizontally 180 degrees before installation. However, the third one will not be rotated. It will face the same direction as the first one. The fourth one will be rotated, facing the same direction as the second one. So, all odd numbers (e.g., 1, 3, 5, 7 . . . ) will face one direction and all even numbers (e.g., 2, 4, 6, 8 . . . ) opposite direction. This means, blades perpendicular to the traffic will be close to each other, while blades with 30 degrees will be close to each other. It is similar to a "head to head" and "tail to tail" arrangement.

Referring again now to FIG. 9 (and also to FIG. 1), the light blocking modules 34 are shown mounted on a concrete barrier 74. It is preferred that the light blocking modules 42 and/or 34 be secured to the barrier 74 on both their upper and lower portions for enhanced stability. There are many ways that this can be accomplished. In a preferred method the lower portions of the light blocking modules are secured to the concrete barrier via a bottom mounting device that comprises a bracket 76.

Figure 11:
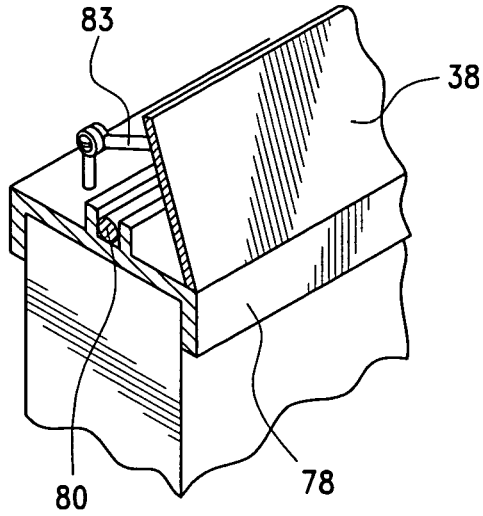
FIG. 11 is a perspective view of an upper portion of the light blocking module of the multi-purpose anti-glare divider system of FIG. 6.

FIG. 11, in conjunction with FIG. 6, illustrate a preferred method of mounting the upper portions of the light blocking modules. Again, various methods may be used. These figures illustrate the use of an upper support bracket 78. The upper support bracket 78 is fixed to a horizontal support element 80 that is, in turn, connected to a vertical support element 82.

In this preferred embodiment the upper support bracket 78 supports a solar panel 38 which serves as an electrical generating system. The solar panel 38 may be adjustably connected to the upper support bracket by means known in the field, for example, an arm assembly 83 including arms connected by a screw and nut.

Referring now to FIGS. 12–15 the lower portions of the light blocking modules are secured to the road via a plurality of pedestal assemblies, designated generally as 84. Each pedestal is shown securely connected to the road 86 via a bolt 88, washer 90 and rubber gasket 92. A nut 94 and wedge 96. Due to the hard surface, one uses an electric drill to drill the hole. Next, the nut 94 and wedge 96 are put into the hole and the nut 94 is pounded with a hammer. As the nut 94 enters deeper into the hole, the bottom part of the nut will split open. As it splits, the split parts will press the wall into the hole. Obviously, other suitable connecting means can be used.

Other embodiments and configurations may be devised without departing from the spirit of the invention and the scope of the appended claims.

What is claimed is:

1. A multi-purpose anti-glare divider system for minimizing glare from oncoming traffic on a two-way road, comprising:

a) at least one light blocking module arranged and constructed to minimize glare from oncoming traffic;

b) an electrical generating system associated with said light blocking module for generating electrical energy for use by an auxiliary device; and, c) a mounting system for supporting said light blocking module in a desired position relative to said road, wherein said at least one light blockin module, comprises at least one fixed-type light blocking module, comprising:

a) a blade mounting frame assembly; and, b) a plurality of spaced fixed blades mounted in said blade mounting frame assembly, said mounting frame assembly having a longitudinal center line substantially parallel to the direction of the road, said spaced fixed blades being positioned to have their angles oriented from about 60° to about 90° from said center line.

2. The multi-purpose anti-glare divider system of claim 1, wherein said at least one fixed light blocking module, comprises a plurality of pairs of said fixed light blocking modules, each pair of said fixed light blocking modules comprising a first fixed light blocking module and a second fixed light blocking module rotated 180° therefrom.

3. The multi-purpose anti-glare divider system of claim 1, further comprising an energy storage system connected to said electrical generating system for storing electrical energy for use by the auxiliary device.

4. The multi-purpose anti-glare divider system of claim 1 wherein said electrical generating system comprises a solar panel assembly mounted on said at least one light blocking module.

5. The multi-purpose anti-glare divider system of claim 1 wherein said mounting system comprises an upper mounting system for securing said at least one light blocking module at an upper end thereof.

6. The multi-purpose anti-glare divider system of claim 5 wherein said upper mounting system comprises:

a) at least one vertical support element having a lower end secured to the road;

b) a horizontal support element secured to said vertical support element for securing an upper portion of said at least one light blocking module.

7. The multi-purpose anti-glare divider system of claim 6 wherein said horizontal support element is secured to said upper portion of said at least one light blocking module via a top mounting device.

8. The multi-purpose anti-glare divider system of claim 1 wherein a lower portion of said at least one light blocking module is secured to a concrete barrier via a bottom mounting device.

9. The multi-purpose anti-glare divider system of claim 1 wherein a lower portion of said at least one light blocking module is secured to the road via a plurality of pedestal assemblies, each being securely connected to the road.

10. The multi-purpose anti-glare divider system of claim 9 wherein said lower portion of said at least one light blocking module is secured to a respective pedestal assembly via a bottom mounting device.

11. The multi-purpose anti-glare divider system of claim 1 wherein at least one light blocking module comprises a plurality of light blocking modules.

12. A multi-purpose anti-glare divider system for minimizing glare from oncoming traffic on a two-way road, comprising:

a) at least one light blocking module arranged and constructed to minimize glare from oncoming traffic;

b) an electrical generating system associated with said light blocking module for generating electrical energy for use by an auxiliary device; and, c) a mounting system for supporting said light blocking module in a desired position relative to said road, wherein said at least one light blocking module, comprises at least one rotatable-type light blocking module, comprising:

a) a blade mounting frame assembly; and, b) a plurality of spaced rotatable blades mounted in said blade mounting frame assembly, said spaced rotatable blades being arranged and positioned to minimize glare from oncoming traffic and to rotate in response to movement of air caused by wind and/or passing vehicles.

13. The multi-purpose anti-glare divider system of claim 12, wherein each rotatable-type light blocking module comprises a rotor assembly comprising a shaft and a plurality of wings, said wings being said rotatable blades, said rotor assembly being supported by said blade mounting frame assembly.

14. The multi-purpose anti-glare divider system of claim 13, wherein each wing has a concave, expanded c-shape.

15. The multi-purpose anti-glare divider system of claim 13, wherein said plurality of wings comprises two wings at 180° from each other.

16. The multi-purpose anti-glare divider system of claim 13, wherein said plurality of wings comprises three wings at 120° from each other.

17. The multi-purpose anti-glare divider system of claim 13, wherein said plurality of wings comprises four wings at 90° from each other.

18. The multi-purpose anti-glare divider system of claim 13, wherein said electrical generating unit, comprises:

a generator assembly operatively associated with said rotor assembly for converting the rotational energy of said rotor assembly to electrical energy.

19. The multi-purpose anti-glare divider system of claim 18 wherein said energy storage system comprises a regulator and rechargeable battery connected to said generator assembly.

20. The multi-purpose anti-glare divider system of claim 12 wherein said electrical generating system comprises a solar panel assembly mounted on said at least one light blocking module.

* * * * *

UNITED STATES PATENT AND TRADEMARK OFFICE

CERTIFICATE OF CORRECTION

PATENT NO. : 6,962,461 B2
DATED : November 8, 2005
INVENTOR(S) : Choi et al.

It is certified that error appears in the above-identified patent and that said Letters Patent is hereby corrected as shown below:

Column 7,
Line 1, delete "blockin" and substitute -- blocking --.

Signed and Sealed this

Eleventh Day of April, 2006

JON W. DUDAS
*Director of the United States Patent and Trademark Office*